US006932755B2

(12) United States Patent
Teshima et al.

(10) Patent No.: US 6,932,755 B2
(45) Date of Patent: Aug. 23, 2005

(54) FOLDING MACHINE WITH COLLECT RUN MODE

(75) Inventors: Tsunetoshi Teshima, Yamato (JP); Hiroyuki Fujinuma, Kunitachi (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/622,591

(22) Filed: Jul. 21, 2003

(65) Prior Publication Data

US 2004/0084825 A1 May 6, 2004

(30) Foreign Application Priority Data

Oct. 31, 2002 (JP) ..... 2002-317163

(51) Int. Cl.[7] ..... B31F 1/10

(52) U.S. Cl. ..... 493/434; 493/357; 493/424; 493/442; 493/454

(58) Field of Search ..... 493/356, 357, 493/359, 360, 405, 416, 424, 434, 442, 454

(56) References Cited

U.S. PATENT DOCUMENTS

| | | | | |
|---|---|---|---|---|
| 4,190,242 A | * | 2/1980 | Bolza-Schunemann | 270/50 |
| 4,892,036 A | * | 1/1990 | Lange | 101/240 |
| 5,065,993 A | * | 11/1991 | Reponty | 270/49 |
| 5,527,256 A | * | 6/1996 | Vauchelle et al. | 493/424 |
| 6,331,154 B1 | * | 12/2001 | Shibuya et al. | 493/424 |

FOREIGN PATENT DOCUMENTS

| | | |
|---|---|---|
| JP | SHO 56-018500 | 4/1981 |
| JP | HEI 7-157192 | 6/1985 |

* cited by examiner

*Primary Examiner*—Louis K. Huynh
*Assistant Examiner*—Christopher Harmon
(74) *Attorney, Agent, or Firm*—Foley & Lardner LLP

(57) ABSTRACT

The folding machine with a collect run mode of this invention comprises folding cylinder fixed cam means for carrying out a straight run at pins, folding cylinder rotating cam means provided with covering section so as to enable rotation of the covering sections for covering a cam shape for carrying out the straight run, jaw cylinder fixed cam means for carrying out a straight run at jaw mechanisms, jaw cylinder rotating cam means provided with covering sections to enable rotation of the covering sections covering a cam shape for carrying out a straight run, drive transmission means for ensuring that the covering sections of the folding cylinder rotating cam means rotate at a predetermined rotational speed ratio with respect to rotation of the folding cylinder and that the covering sections of the jaw cylinder rotating cam means rotate at a predetermined rotational speed ratio with respect to rotation of the jaw cylinder, and switching means for switching over driving between the folding cylinder rotating cam means and the jaw cylinder rotating cam means, wherein odd numbers of pins and folding blades of the folding cylinder and the jaw mechanisms of the jaw cylinder are provided positioned at equal distances along the direction of the peripheral surface of the cylinder surface.

8 Claims, 9 Drawing Sheets

FOLDING MACHINE WITH COLLECT RUN MODE

BACKGROUND OF THE INVENTION

1. Field of the Invention

This invention relates to a folding machine for a rotary press, and more particularly relates to a folding machine with a collect run mode capable of folding in such a manner as to be capable of selectively switching over between straight folding and collect folding when folding a paper web printed on using a printing unit using a folding cylinder and a jaw cylinder parallel to the axes of these cylinders after cutting the paper web.

2. Description of the Related Art

Conventionally, with folding machines for rotary presses, folding machines provided with operating functions for switching between straight folding and collect folding such as technology (prior art 1) disclosed in Japanese Patent Application Laid-open No. Hei. 7-157192 and the technology (prior art 2) disclosed in Japanese Patent Publication No. Sho. 56-018500 are well known.

The folding machines disclosed in prior arts 1 and 2 have formers and folding cylinders. This group of folding cylinders comprises a cutting cylinder having a cutting knife for cutting the paper web folded by the former to a prescribed length, pins for releasing the cut paper at an appropriate timing after sequentially holding the leading part of the cut paper sequentially at peripheral surfaces of the cylinders, a folding cylinder having a folding blade provided with a tip projecting slightly from the cylinder surface so as to cause a central part of the cut paper held at the cylinder surface to project in a direction parallel to the axial direction of the cylinder, and a jaw cylinder provided facing the folding blade provided at the folding cylinder surface, equipped with a jaw mechanism for holding the central part of the cut paper projected by the folding blade and folding this in a direction parallel to the axis of the cylinder.

With the straight folding by the folding machine disclosed in prior arts 1 and 2, after forming papers cut for each pattern from a paper web on which the same pattern has been printed consecutively by a printing unit, the papers cut with the same pattern are sequentially held at the surface of the folding cylinder, and each item of cut paper held is held by the jaw mechanism of the jaw cylinder and folded to give a signature.

More specifically, each of the pins of the folding cylinder is pulled in to within the folding cylinder one time during one revolution of the folding cylinder and the cut paper at the surface of the folding cylinder is passed over from the folding cylinder to the jaw cylinder so as to give a signature once for every 1/M revolutions of the folding cylinder (where M is the number pieces of cut paper it is possible to hold at the surface of the folding cylinder).

With collect folding using the folding machines disclosed in prior arts 1 and 2, cut paper is formed for each pattern from a paper web printed consecutively back and forth with two different patterns using a printing unit. This cut paper with differing patterns is then sequentially held at the surface of the folding cylinder, the folding cylinder is rotated one time, and at a position where the cut paper is held by pins, a new cut paper with a different pattern is overlaid and held, with each cut paper then being held by the jaw mechanism of the jaw cylinder and folded to give a signature in the same way as for during straight folding.

More specifically, as it is possible to overlay cut paper with different patterns on the folding cylinder surface, the number of pieces of cut paper M it is possible to hold at the surface of the folding cylinder, i.e. the number M of pins and folding blades, is taken to be an odd number, each of the pins of the folding cylinder is pulled into the folding cylinder one time during two revolutions of the folding cylinder and the cut paper on the folding drum surface is passed from the folding cylinder to the jaw cylinder one time for every 2/M revolutions of the folding cylinder (where M is the number of pieces of cut paper it is possible to hold at the surface of the folding cylinder).

Next, a detailed description is given of the folding mechanism disclosed in prior art 1. The folding machine of prior art 1 is alternately provided with odd-numbered rows (three or five) of pins and odd-numbered rows (three or five) of folding blades in a circumferential direction of the cylinder surface. When the folding cylinder rotates, a cam follower coupling with the pins is guided, and the fixed cam for moving the pins forwards or backwards from the surface of the cylinder is fixed to the side of the frame.

The cam profile of the fixed cam 1 comprises a circular peripheral part causing the pins to advance projecting from the surface of the folding cylinder and a recess part causing the pins to retract and be drawn in from the surface of the cylinder. At the recess part of the fixed cam, the pins release held cut paper from the cylinder surface by being retracted and enable delivery of the cut paper to cylinders downstream. The fixed cam has a recess at the prescribed position for carrying out a straight run.

A rotating cam is provided rotating at a position next to the fixed cam with a predetermined prescribed rotational speed ratio with respect to the rotation of the folding cylinder in accompaniment with the rotation of the folding cylinder.

The rotational cam is partially provided with partial covering sections of the same outer diameter as the outer diameter of the circular peripheral surface part of the fixed cam so as to enable covering of the recess part of the fixed cam, with other outer peripheral surface portions having a smaller diameter than the outer diameter of the circular peripheral surface part of the fixed cam and constituting non-covering sections that do not cover the recess part of the fixed cam.

Further, a rotating cam is disclosed where the rotating cam has covering sections at two symmetrical portions, and the other outer surface portions are taken to be non-covering sections.

The rotating cam rotates at a predetermined prescribed rotational speed ratio with respect to the rotation of the folding cylinder in accompaniment with the rotation of folding cylinder and it is possible for a large diameter part of the rotating cam to cover a small diameter part of the fixed cam. As a result, the pins hold two pieces of cut paper at the surface of the folding cylinder. This is then delivered to the jaw mechanism of the jaw cylinder so as to give a mechanism that folds by carrying out collect folding. Folding blades provided at the folding cylinder are fixed to the folding cylinder body and do not perform an operation of advancing and retreating from the surface of the folding cylinder.

Further, an even number of rows of jaw mechanisms (six rows) are provided at the jaw cylinder in the circumferential direction of the jaw cylinder. Moreover, although this is not described in detail, all of the jaw mechanisms operate during straight run, while the jaw mechanisms operate every other row, i.e. just a predetermined number of three rows of the six rows operate at the same time during collect folding.

Next, a detailed description is given of the folding machine disclosed in prior art 2. The folding machine of prior art 2 is alternately provided with odd-numbered rows (three) of pins and odd-numbered rows (three) of folding blades at the folding cylinder in a circumferential direction of the cylinder surface, and also provided with two cams fixed and spaced with respect to each other at the frame side, a cam guiding a cam follower coupled with pins in accompaniment with the rotation of the cylinder, the other cam guiding a cam follower coupled with the folding blade to cause the folding blade to advance or retract from the surface of the folding cylinder.

The cam profile of the fixed cam guiding the cam follower coupling with the pins comprises a large diameter section causing the pins to advance and project from the surface of the folding cylinder and a small diameter section causing the pins to retract to withdraw from the surface of the folding cylinder. The cam profile of the fixed cam guiding the cam follower coupling with the folding blade comprises a small diameter section causing the folding blade to advance and project from the surface of the folding cylinder and a large diameter section causing the folding blade to retract to withdraw from the surface of the folding cylinder.

At the small diameter section of the fixed cam for the pins, the pins retract from the cylinder surface to release the held cut paper, while at the small diameter at the fixed cam of the folding blade, the folding blade projects from the surface of the cylinder to cause a central part of the cut paper to project at the jaw mechanism of the jaw cylinder facing the folding blade, and the cut paper is delivered to a downstream jaw cylinder. The fixed cam is a shape for carrying out straight run, i.e. the prescribed position is the small diameter section.

Further, a rotating cam for the pins and a rotating cam for the folding blades rotating in accompaniment with rotation of the folding cylinder are provided between the fixed cam for the pins and the fixed cam for the folding blades. The two rotating cams are next to each other with a gap therebetween and are provided so as to be capable of being rotated in an integral manner.

These rotating cams comprise a rotating cam for the pins positioned at the side of the fixed cam for the pins and of a shape such that it is possible for the large diameter section of the rotating cam to shield the small diameter section of the fixed cam for the pins and a rotating cam for the folding blade positioned at the side of the fixed cam of the folding blade and of a shape such that it is possible for the large diameter section of the rotating cam to shield the small diameter section of the fixed cam of the folding blade.

The rotating cam rotates at a predetermined prescribed rotational speed ratio with respect to the rotation of the folding cylinder in accompaniment with the rotation of folding cylinder and it is possible for the large diameter section of the rotating cam to individually block the small diameter section of the fixed cam for the folding blade. As a result, the pins hold two pieces of cut paper overlaid at the surface of the jaw mechanism of the jaw cylinder so as to give a mechanism that folds by carrying out collect folding.

The jaw cylinder is such that jaw mechanisms composed of an odd number of rows (three) of jaw blades and jaw anvils are provided at equally spaced positions about the circumferential direction of the jaw cylinder. Further, a cam is provided by being fixed to the frame side for guiding a cam follower coupled with the jaw blade in accompaniment with the rotation of the jaw cylinder and for causing an operation where the jaw blade moves towards and away from the jaw anvils so as to open and close the jaw mechanism.

This fixed cam is provided with a small diameter section acting in such a manner that the jaw blades come away from the jaw anvils so that the jaw mechanism is put in an open state, and a large diameter section acting in such a manner that the jaw blades come close to the jaw anvils, so that the jaw mechanism is put in a closed state. The fixed cam is of a shape for carrying out straight folding, and specifically the cam shape is such that each jaw mechanism closes and opens once during one rotation of the jaw cylinder.

The following problems are encountered in prior art 1 and prior art 2.

An even number (six) of rows of jaw mechanisms are provided for the jaw cylinder disclosed in prior art 1 so that during collect folding, every other one of the jaw mechanisms are operating in the jaw mechanisms of the jaw cylinder. The six rows of jaw mechanisms can therefore be divided up into three jaw mechanisms that are operating and three jaw mechanisms that are not operating.

The number of times of operation of a bearing for the cam follower coupling with the jaw mechanisms, every other one of which is operating, is high and this bearing therefore wears out very quickly. The generation of noise due to this wearing therefore starts to occur earlier and lifespan is therefore shortened.

An odd number of rows of pins (three) and an odd number of rows (three) of folding blades are provided at the folding cylinder disclosed in prior art 2. During the collect run, the pins and the folding blades of the folding cylinder act in such a manner that every other one of the pins and the folding blades project from the surface of the cylinder. However, the odd number of rows (three) of jaw mechanisms provided on the jaw cylinder facing the folding blade all act so as to open and close in the same way as during a collect run or during a straight run. So-called "paperless strikes" where the jaw mechanism is closed but there is no paper are therefore carried out with respect to every other folding blade that is retracted and held back from the surface of the cylinder.

When the jaw mechanism carries out an empty strike, it is not just the parts that are directly struck such as the jaw blades and jaw anvils making up the jaw mechanism that are affected, but also wearing of the shafts coupling to these parts and the cam follower bearings etc. is speeded up so that the lifespan becomes shorter and noise due to friction is increased.

SUMMARY OF THE INVENTION

It is therefore an object of this invention to provide a folding machine where the maintenance burden is alleviated and use of the device for long periods is possible because paperless strikes of each jaw mechanism of a jaw cylinder do not occur during a collect run of the folding machine, because all of the jaw mechanisms operate at the same frequency without exception, the advancement of wear of part of the jaw mechanism due to partial use is prevented, the occurrence of noise due to this wear is prevented, and the rapid wear of the jaw mechanism due to the paperless strikes is also prevented.

In order to resolve the aforementioned problems, a folding machine with a collect run mode has a cutting cylinder equipped with cutting blades for cutting a paper web to give cut paper, a folding cylinder provided next to the cutting cylinder and provided with pins for holding the cut paper and folding blades provided with ends projecting slightly from the cylinder surface positioned at a central part of the held cutting paper, and a jaw cylinder next to the folding cylinder provided with a jaw mechanism for holding and supporting a central part of the cut paper made to project by a folding blade, and is capable of switching between a straight run where the jaw cylinder sequentially supports the cut paper and the cut paper is folded and a collect run where two pieces of the cut paper are sequentially overlaid by the folding cylinder and the jaw cylinder sequentially supports and then folds the two overlaid pieces of cut paper, said folding machine with collect run mode comprising: folding cylinder fixed cam means having a folding cylinder fixed cam of a cam shape for making the pins of the folding cylinder perform a straight run delivery operation; folding cylinder rotating cam means having a folding cylinder rotating cam provided with covering sections capable of covering a cam shape capable of carrying out a straight run delivery operation of the folding cylinder cam by rotational displacement; jaw cylinder fixed cam means having a jaw cylinder fixed cam of a cam shape for making the jaw mechanism of the jaw cylinder perform a straight run delivery operation; jaw cylinder rotating cam means having a jaw cylinder rotating cam provided with covering sections capable of covering a cam shape capable of carrying out a straight run delivery operation of the jaw cylinder cam by rotational displacement; drive transmission means capable of providing rotational drive to the folding cylinder rotating cam means and the jaw cylinder rotating cam means in order to cause the covering sections of the folding cylinder rotating cam means to rotate at a predetermined rotational speed ratio with respect to rotation of the folding cylinder, and cause the covering sections of the jaw cylinder rotating cam means to rotate at a predetermined rotational speed ratio with respect to rotation of the jaw cylinder; and switching means for switching drive transmission over between the folding cylinder rotating cam means and the jaw cylinder rotating cam means, wherein an odd number of pins and folding blades of the folding cylinder are provided positioned at equal distances along the direction of the peripheral surface of the folding cylinder surface, and an odd number of jaw mechanisms of the jaw cylinder are provided along the direction of the peripheral surface of the jaw cylinder.

DETAILED DESCRIPTION OF THE PREFERRED EMBODIMENTS

Figure 1:
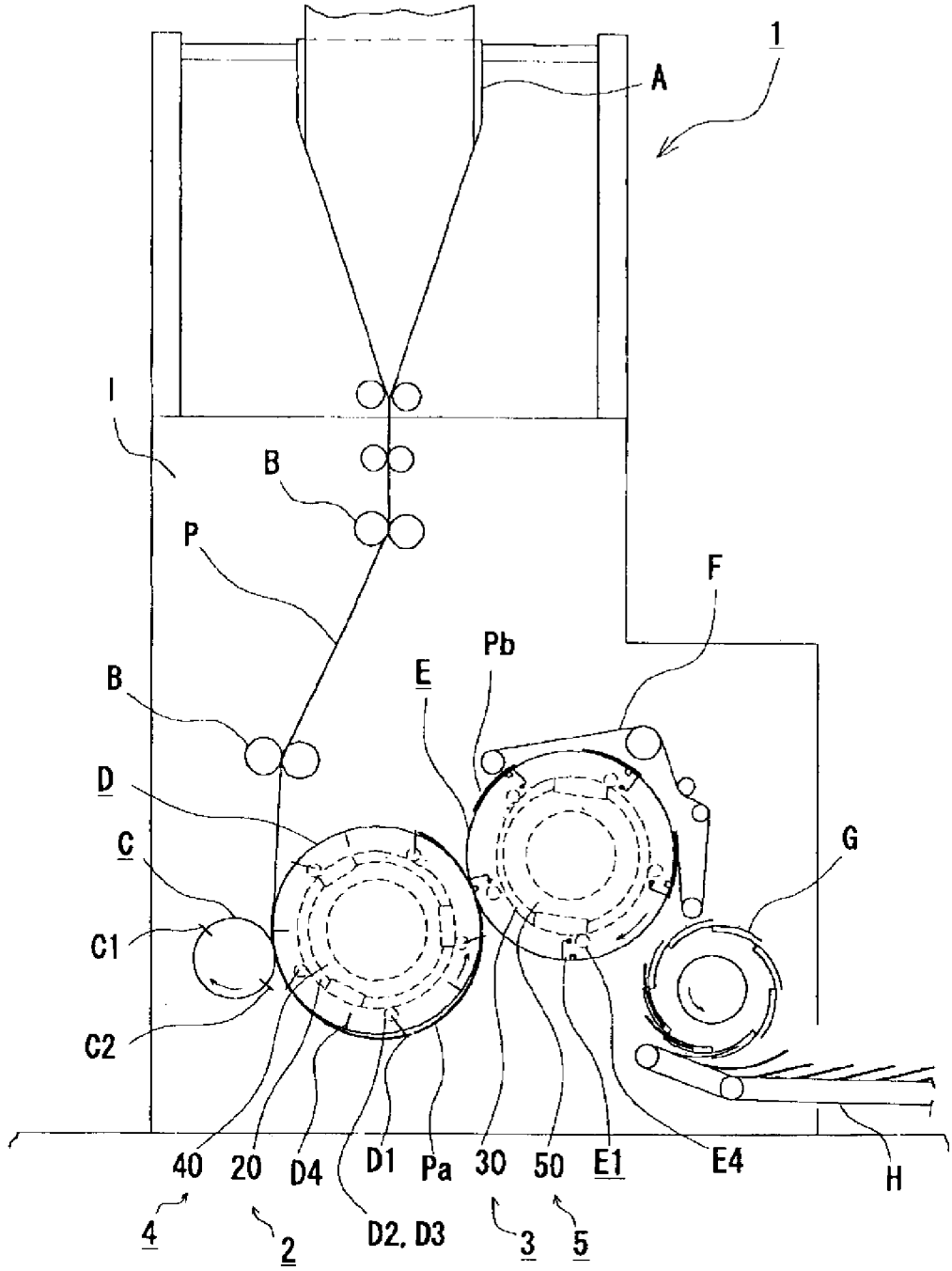
FIG. 1 is a side view of a folding machine with a collect run mode of an embodiment of this invention.
Figure 2:
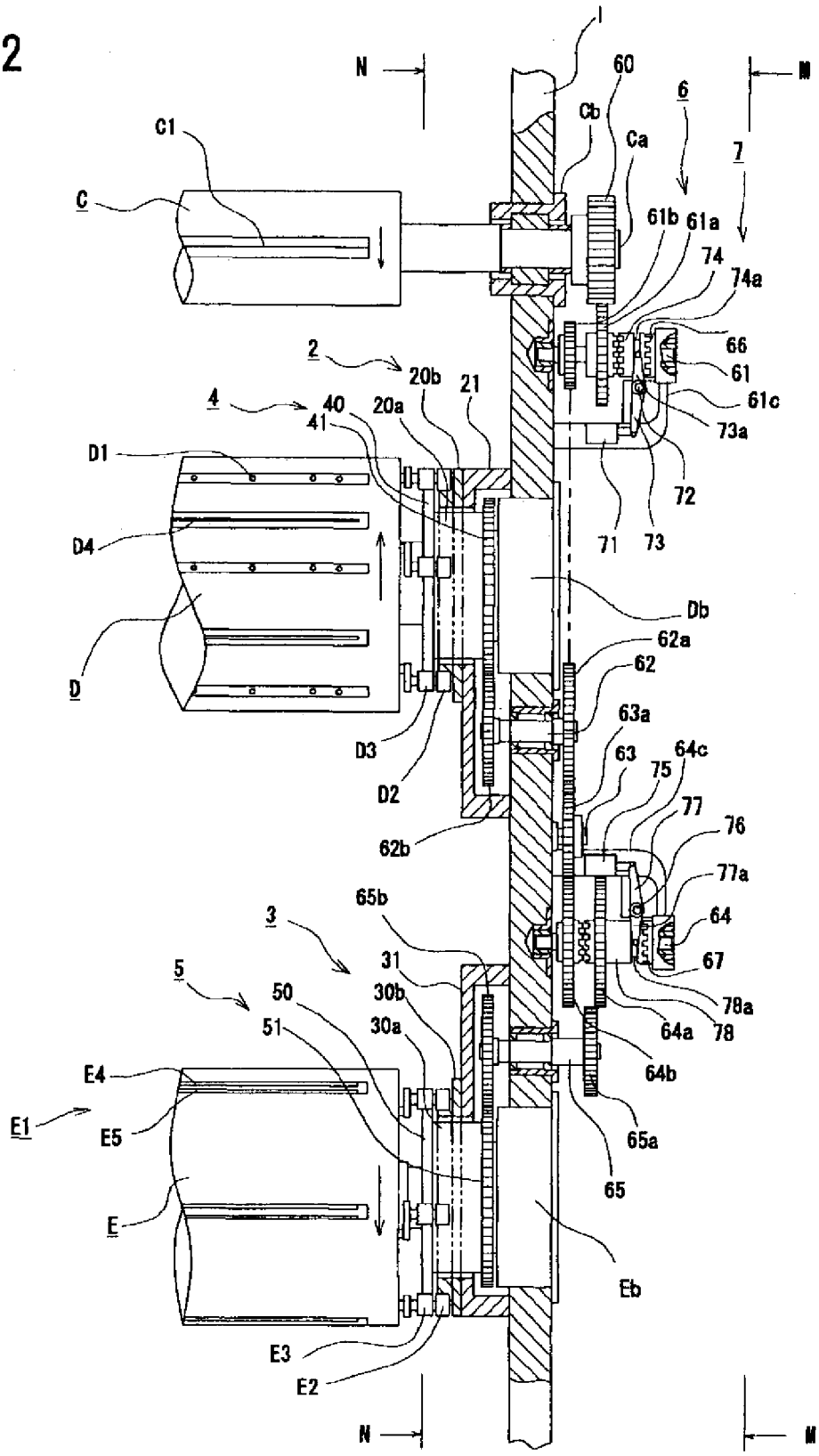
FIG. 2 is a partial enlarged cross-sectional view of a cutting cylinder, folding cylinder and jaw cylinder of the same folding machine with a collect run mode.
Figure 3:
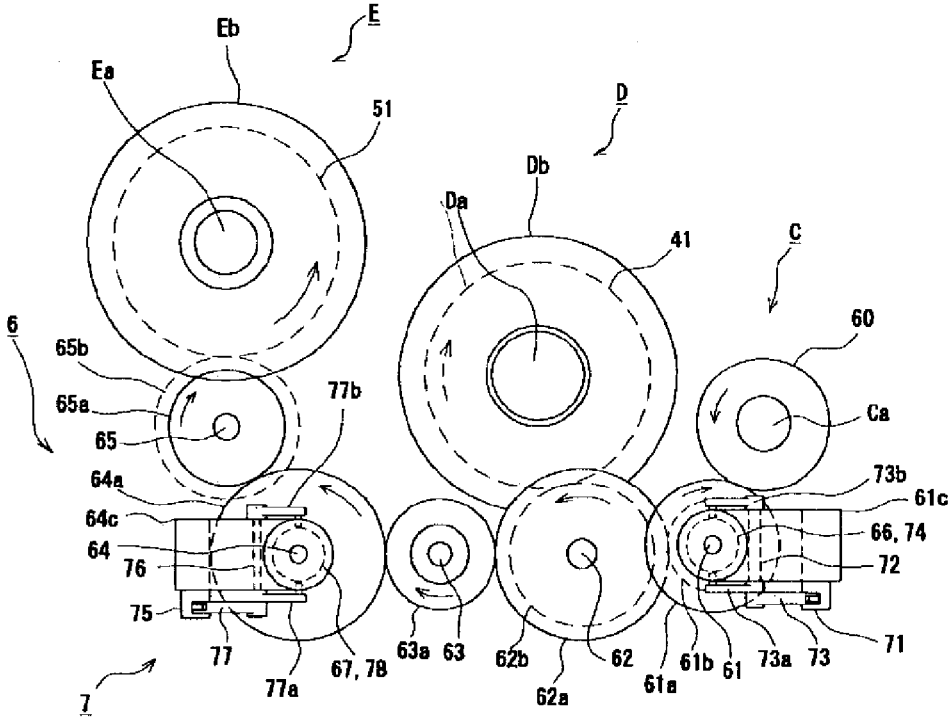
FIG. 3 is a view of the same taken along MM of FIG. 2.
Figure 4:
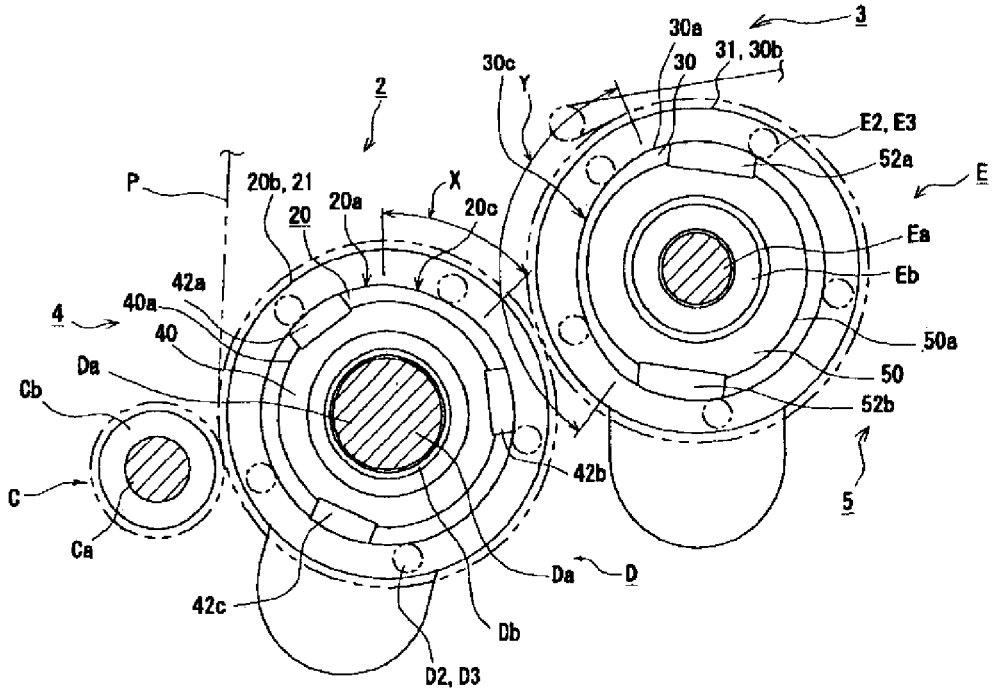
FIG. 4 is a view of the same taken along NN of FIG. 2.
Figure 5:
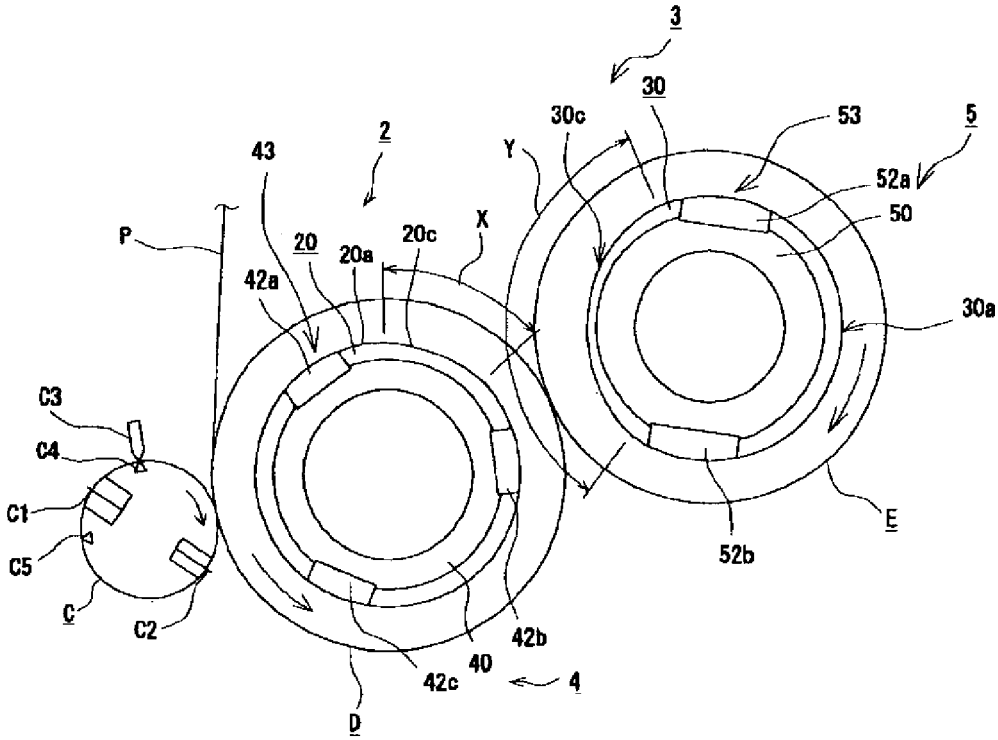
FIG. 5 is an operational view illustrating the positioning of cylinders during switching over of the folding machine with a collect run mode of the embodiment of the invention between a straight run and a collect run.
Figure 6:
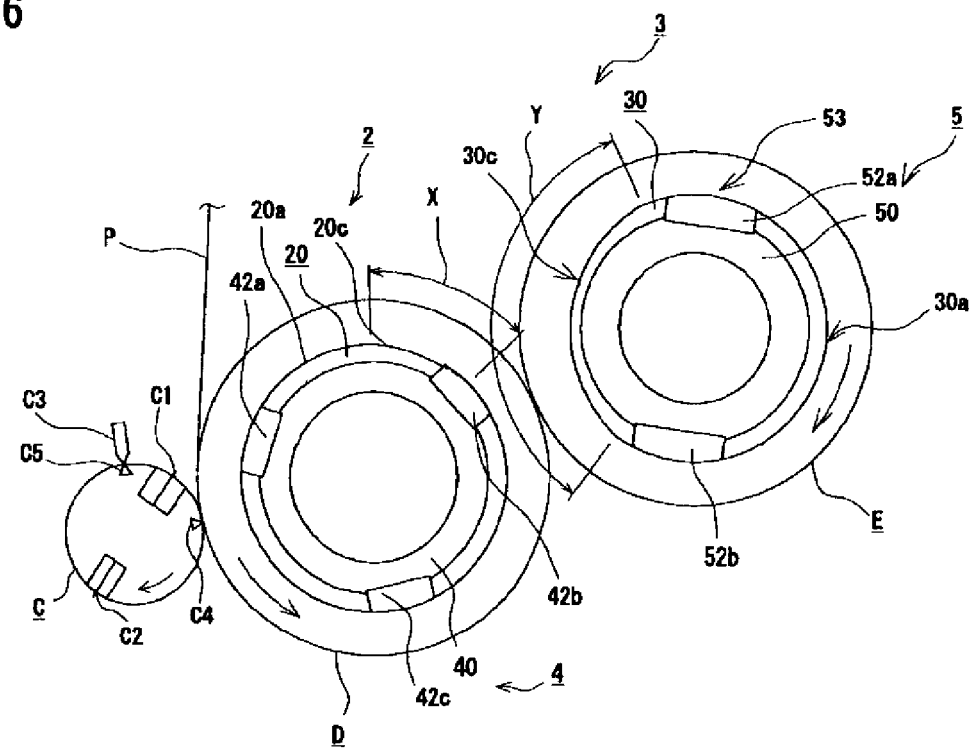
FIG. 6 is a further operational view illustrating the positioning of cylinders during switching over of the folding machine with a collect run mode of the embodiment of the invention between a straight run and a collect run.

A description is now given based on drawings showing an embodiment of this invention, i.e. based on FIG. 1 showing a side view of a folding machine with a collect run mode of an embodiment of this invention, FIG. 2 showing a partial enlarged cross-sectional view of a cutting cylinder, folding cylinder and jaw cylinder of the same folding machine with a collect run mode, FIG. 3 showing a view of the same taken along MM of FIG. 2, FIG. 4 showing a view of the same taken along NN of FIG. 2, FIG. 5 and FIG. 6 showing operational views illustrating the positioning of cylinders during switching over between straight a straight run and a collect run of the machine of this invention, and FIGS. 7 to 15 that are views illustrating folding cylinder rotating cam means and jaw cylinder rotating cam means occurring in a collect run of the folding machine of the invention.

A folding machine with a collect run mode 1 for a rotary press comprises a former A, nipping rollers B, cutting cylinder C, folding cylinder D, jaw cylinder E, conveyor belt F, fan G, conveyor H and frame I, as shown in FIG. 1.

The former A folds a paper web P that passes through print units (not shown) longitudinally into two. The nipping rollers B then sandwich the paper web P that has been folded into two and send this downwards. The cutting cylinder C has a cutting blade for cutting the paper web P sent from the nipping rollers B to a prescribed length to give cut paper Pa. The folding cylinder D then has an action of supporting the leading part of the cut paper Pa using pins D1 provided at the cylinder surface. The jaw cylinder E then holds the central part of the cut paper Pa held at the surface of the folding cylinder D and holds and receives the cut paper Pa using a jaw mechanism E1 provided at the cylinder surface in such a manner as to fold the cut paper Pa parallel to the axis of the cylinders so as to make a signature Pb.

The conveyor belt F comes into contact with the surface of the jaw cylinder E, holds the signature Pb at the surface of the jaw cylinder E, and conveys the signature Pb. The fan G provided at the bottom of the jaw cylinder E receives the signatures Pb released and dropped from the conveyor belt F so as to fall one by one. The conveyor H is provided below the fan G and offsets and stacks signatures Pb caught by the fan G for conveying to outside of the machine.

Further, the cutting cylinder C is provided with blades C1 and C2 spaced by 180 degrees in the circumferential direction for cutting the paper web P. An uneven number (in this embodiment, five) of rows of pins D1 (D1*a*, D1*b*–D1*e*) and an uneven number (in this embodiment, five) of folding blades D4 (D4*a*, D4*b*–D4*e*) are provided alternately spaced equidistantly along the circumferential direction of the cylinder at the folding cylinder D. An uneven number (in this embodiment, five) of rows of jaw mechanisms E1 (E1*a*, E1*b*–E1*e*) are provided positioned at equal distances along the circumferential direction of the jaw cylinder E.

The cutting cylinder C is supported in a freely rotating manner between frames I, I via bearings provided at bearing sleeves Cb, Cb at both ends of a shaft Ca. The shaft Ca projects to outside of the frame I at one end as shown in FIG. 2 and is fitted with a drive gear 60. The folding cylinder D is supported in a freely rotating manner at frames I via bearings (not shown) provided at bearing sleeves Db provided at both ends of a shaft Da. The jaw cylinder E is supported in a freely rotating manner at frames I via bearings (not shown) provided at bearing sleeves Eb provided at both ends of a shaft Ea.

All of the means relating to this invention relate to the cutting cylinder C, folding cylinder D and jaw cylinder E supported between the frames I, I shown in FIG. 2, and one frame I is therefore provided facing one side surface of these cylinders. Namely, folding cylinder fixed cam means 2, jaw cylinder fixed cam means 3, folding cylinder rotating cam means 4, jaw cylinder rotating cam means 5, drive transmission means 6, and switching means 7.

The folding cylinder fixed cam means 2 guides a cam follower D2 coupling with pins D1 provided at the folding cylinder D. The folding cylinder fixed cam means 2 is provided with a cam anvil 21 at the inside of the frame I as shown in FIG. 2. A folding cylinder fixed cam 20 is then provided at this cam anvil 21 at a surface facing the side surface of the folding cylinder D. The folding cylinder fixed cam 20 has a stepped link shape comprising a small diameter section taking a round guide surface 20*a* as a peripheral surface and a large diameter flange section 20*b*, and is provided with the same coaxial center as the shaft Da of the folding cylinder D. The folding cylinder fixed cam 20 is fitted so that the side surface of the large diameter flange section 20*b* is fixed to the cam anvil 21. The cam follower D2 on the side of the frame I of two parallel cam followers D2, D3 coupling with the pins D1 comes into contact with the round guide surface 20*a* of the folding cylinder fixed cam 20 in such a manner that the pins D1 provided on the folding cylinder D retract from the cylinder surface. This round guide surface 20*a* guides the cam follower D2 moving in accompaniment with rotation of the folding cylinder D.

As shown in FIG. 4, the shape of the round guide surface 20*a* of the small diameter section of the folding cylinder fixed cam 20 is substantially circular with the same coaxial center as the shaft Da of the folding cylinder D. In the direction of rotation of the folding cylinder D, the range on the downstream side of the minimum gap between the folding cylinder D and the jaw cylinder E is a retraction range guide surface 20*c* constituted by recessed portions making the diameter of the small diameter section even smaller, with this range then being taken as a pin retraction range X. When the cam follower D2 making contact with this pin retraction region X is moving, the radial direction of the cylinder is displaced, and the pins D1 of the folding cylinder D coupled with the cam follower D2 are retracted from the cylinder surface to within the cylinder. When the pins D1 of the folding cylinder D retract from the cylinder surface to within the cylinder, this is accompanied by the holding of the cut paper Pa by the pins D1 at the surface of the cylinder being released.

The jaw cylinder fixed cam means 3 guides a cam follower E2 coupling with the jaw mechanism E1 provided at the jaw cylinder E. The jaw cylinder fixed cam means 3 is provided with a cam anvil 31 at the inside of the frame I as shown in FIG. 2. A jaw cylinder fixed cam 30 is then provided on this cam anvil 31 at a surface facing the side surface of the jaw cylinder E. The jaw cylinder fixed cam 30 has a stepped ring shape comprising a small diameter section taking a round guide surface 30*a* as a peripheral surface and a large diameter flange section 30*b*, and is provided with the same coaxial center as the shaft Ea of the jaw cylinder E. The jaw cylinder fixed cam 30 is fitted so that the side surface of the flange of the large diameter flange section 30*b* is fixed to the cam anvil 31.

A cam follower E2 on the side of the frame I of the parallel cam followers E2, E3 coupling with the jaw mechanism E1 comes into contact with the round guide surface 30*a* of the jaw cylinder fixed cam 30 in such a manner that the jaw mechanism E1 of the jaw cylinder E opens and closes. This round guide surface 30*a* guides the cam follower E2 moving in accompaniment with rotation of the jaw cylinder E.

As shown in FIG. 4, the shape of the round guide surface 30*a* of the small diameter section of the jaw cylinder fixed cam 30 is substantially circular with the same coaxial center as the shaft Ea of the jaw cylinder E. In the direction of rotation of the jaw cylinder E, the range extending from the upstream side to the vicinity of the starting end of the conveyor belt F for the minimum gap between the folding cylinder D and the jaw cylinder E is a closed range guide surface 30*c* constituted by marginally retracted portions making the diameter of the small diameter section even smaller, with this range then being taken as a holding closed range. When the cam follower E2 making contact at this jaw closed range Y is moving, the cylinder is displaced in a radial direction. While the jaw mechanism E1 is facing the folding blade D4 of the folding cylinder D at the position of a minimum gap between the folding cylinder D and the jaw cylinder E, the jaw mechanism E1 of the jaw cylinder E coupled with the cam follower E2 is in a closed state. The central part of the cut paper Pa is therefore held and supported, the cut paper Pa is folded parallel to the shaft of the jaw cylinder E to give the signature Pb, and the signature Pb is made to move about surface of the jaw cylinder E.

When the leading part of the signature Pb held by the jaw mechanism E1 is sandwiched between the conveyor belt F and the cylinder surface, the cam follower E2 is freed from the closed range guide surface 30*c* that is the jaw closed range Y and moves along the round guide surface 30*a*, and the jaw mechanism E1 is in an open state so that the signature Pb is released.

The folding cylinder rotating cam means 4 is provided so as to be capable of rotating about a coaxial center at the peripheral surfaces of boss sections of bearing sleeves Db supporting the shaft Da of the folding cylinder D between one side surface of the folding cylinder D and the folding cylinder fixed cam means 2. Covering sections 42*a*, 42*b* and 42*c* constituting three circular arc portions of a shape overlapping with the cam profile of the small diameter round guide surface 20*a* of the folding cylinder fixed cam means 2 are provided spaced apart by 120 degrees.

Namely, as shown in FIG. 2, the folding cylinder rotating cam means 4 comprises a gear 41 provided in a rotatable manner on the same coaxial center as that of the shaft D of the folding cylinder D and a folding cylinder rotating cam 40 provided in a rotatable manner on the same coaxial center as that of the shaft Da of the folding cylinder D at the side surface of the boss section of the gear 41.

The folding cylinder rotating cam 40 is provided so as to overlap with the folding cylinder fixed cam 20 while leaving a gap between the folding cylinder fixed cam 20 which is a ring-shaped plate shown in FIG. 4 of the folding cylinder fixed cam means 2 and the side surface of the folding cylinder D, and comprises a base section 40*a* of a smaller diameter than the folding cylinder fixed cam 20 and three covering sections 42*a*, 42*b* and 42*c* positioned every 120 degrees about the peripheral surface with substantially the same diameter as the round guide surface 20*a* of the folding cylinder fixed cam 20 comprised by plate segment members constituted by circular arc-shaped portions provided so as to be capable of covering the pin retraction region X of the retraction range guide surface 20*c* of the folding cylinder fixed cam 20 as a result of rotational displacement.

The jaw cylinder rotating cam means 5 is provided at the peripheral surfaces of the boss sections for the bearing sleeves Eb supporting the shaft Ea of the jaw cylinder E between one side surface of the jaw cylinder E and the jaw cylinder fixed cam means 3 so as to be capable of rotation about the coaxial center of the shaft Ea for the jaw cylinder E, and also provided with covering sections 52*a*, 52*b* so as to be spaced by 180 degrees and be constituted by two circular arc portions constituting a cam profile of a small diameter section for the jaw cylinder fixed cam means 3.

Namely, as shown in FIG. 2, the jaw cylinder rotating cam means 5 comprises a gear 51 provided in a rotatable manner at the same coaxial center as that the jaw cylinder E at the surface of the boss section of the bearing sleeve Eb of the jaw cylinder E and a jaw cylinder rotating cam 50 provided in a rotatable manner on the same coaxial center as that of the shaft Ea of the jaw cylinder E at the side surface of the boss section of the gear 51.

The jaw cylinder rotating cam 50 is provided so as to overlap with the jaw cylinder fixed cam 30 while leaving a gap between the jaw cylinder fixed cam 30 which is a ring-shaped plate shown in FIG. 4 of the jaw cylinder fixed cam means 3 and the side surface of the jaw cylinder E, and comprises a base section 50*a* of a smaller diameter than the round guide surface 30*a* of the jaw cylinder fixed cam 30 and two covering sections 52*a*, 52*b* positioned at 180 degrees about the peripheral surface with substantially the same diameter as the round guide surface 30*a* of the jaw cylinder fixed cam 30 comprised by plate segment members constituted by circular arc-shaped portions provided so as to be capable of covering the jaw closed range Y of the jaw cylinder fixed cam 30 as a result of rotational displacement.

The drive transmission means 6 transmits rotational drive from a drive source to the folding cylinder rotating cam means 4 and the jaw cylinder rotating cam means 5.

The cutting cylinder C is driven so as to rotate in synchronization with the drive speed of the printing units (not shown). The drive gear 60 is then provided at the end of the shaft Ca of the cutting cylinder C at the outer side of the frame I as shown in FIG. 2.

(1) A bracket 61*c* provided below the drive gear 60 at the outer side surface of the frame I shown in FIG. 1, FIG. 2 and FIG. 3 rotatably supports a shaft 61 parallel with the shaft Ca of the cutting cylinder C with the outer side surface of the frame I. The drive gear 60 and a meshing gear 61*a* are provided in a rotatable manner at the shaft 61 and a gear 61*b* rotating integrally with the shaft 61 is provided at the shaft 61 between the gear 61*a* and the frame I.

The shaft 61 between the gear 61*a* and the bracket 61*c* is provided with a clutch 74 for the switching means 7 which is movable in the axial direction via a sliding key (not shown) provided at the shaft 61 and rotatable integrally with the shaft 61. Mutually meshing recessing and projecting sections are provided on both facing sides of the gear 61*a* and the clutch 74.

Further, a stopper 66 is provided at the surface facing the side of the clutch 74 of the bracket 61*c* supporting the shaft 61 and mutually meshing recessing and projecting sections are also provided at mutually facing sides of the clutch 74 and the stopper 66.

(2) At the frame I at a position below the shaft Da of the folding cylinder D, a shaft 62 with ends projecting to the inside and the outside of the frame I parallel to the shaft Da is supported in a rotatable manner at the frame I. At the shaft 62, a gear 62*a* is provided so as to be capable of rotating integrally with the shaft 62 at the end on the outside of the frame I and a gear 62*b* capable of rotating integrally with the shaft 62 is provided at the end on the inside of the frame I. The gear 62*a* meshes with the gear 61*b* and the gear 62*b* meshes with the gear 41 of the folding cylinder rotating cam means 4.

Next, as a result of operation of the switching means 7, the clutch 74 moves in the axial direction and when the clutch 74 engages with the gear 61*a*, the shaft 61 couples with the gear 61*a* via the clutch 74 so that the shaft 61 rotates in accompaniment with rotation of the gear 61*a* so that the folding cylinder rotating cam 40 of the coupled folding cylinder rotating cam means 4 rotates.

Further, when the clutch 74 comes away from the gear 61*a* and engages with the stopper 66, the shaft 61 is made to stop rotating by the clutch 74 and the folding cylinder rotating cam 40 coupling with the shaft 61 via the gear 41, gear 62*b*, shaft 62, gear 62*a* and gear 61*b* is also made to stop. The folding cylinder rotating cam 40 is therefore not angularly displaced even in the case of vibration during machine operation or when directly subjected to external force.

(3) A pin 63 parallel with the shaft 62 and next to the shaft end of the shaft 62 on the outside of the frame I is provided on the outside surface of the frame I and a rotatable gear 63*a* is provided at the pin 63. The gear 63*a* meshes with the gear 62*a*.

(4) A bracket 64*c* provided at the outer side surface of the frame I below the shaft Ea of the jaw cylinder E shown in FIG. 1, FIG. 2 and FIG. 3 rotatably supports a shaft 64 parallel with the shaft Ea of the jaw cylinder E with the outer side surface of the frame I.

A shaft 63 and a meshing gear 64 are provided in a rotatable manner at the shaft 64 and a clutch 78 for the switching means 7 is provided between the gear 64*b* and the bracket 64*c* so that movement in the axial direction is possible via a sliding key (not shown) and is provided so as to rotate integrally with the shaft 64. Mutually meshing recessing and projecting sections are provided on both facing sides of the gear 64*a* and the clutch 78.

Further, a stopper 67 is provided at the surface facing the side of the clutch 78 of the bracket 64*c* supporting the shaft 64 and mutually meshing recessing and projecting sections are also provided at mutually facing sides of the clutch 78 and the stopper 67.

Further, a gear 64*a* is provided so as to be capable of rotation and of movement in an axial direction integrally with the clutch 78 at the peripheral surface at the side of the gear 64*b* of the clutch 78.

(5) At the frame I at a position below the shaft Ea of the jaw cylinder E, a shaft 65 with ends projecting to the inside and the outside of the frame I parallel to the shaft Ea is supported in a rotatable manner at the frame I. At the shaft 65, a gear 65*a* is provided so as to be capable of rotating integrally with the shaft 65 at the end of the outside of the frame I and a gear 65*b* capable of rotating integrally with the shaft 65 is provided at the end of the inside of the frame I. The gear 65*a* meshes with the gear 64*a* and the gear 65*b* meshes with the gear 51 of the jaw cylinder rotating cam means 5.

The gear 64*a* is provided so as to mesh with the gear 65*a* without coming away from the gear 65*a* even in the case of movement accompanying movement in the axial direction of the clutch 78.

Then, as a result of the action of the switching means 7, when the clutch 78 moves in the axial direction and couples with the gear 64*b*, the gear 64*a* couples with the gear 64*b* via the clutch 78, and the gear 64*a* also rotates in accompaniment with rotation of the gear 64*b*. As a result, the jaw cylinder rotating cam 50 of the jaw cylinder rotating cam means 5 coupled to the gear 64*a* via the meshing gear 65*a* rotates.

Further, when the clutch 78 comes away from the gear 64*b* and meshes so as to engage with the stopper 67, the gear 64*a* is made to stop rotating by the clutch 78 and the jaw cylinder rotating cam 50 coupling with the gear 64*a* via the gear 51, gear 65*b*, shaft 65 and gear 65*a* is also made to stop. The jaw cylinder rotating cam 50 is therefore not angularly displaced even in the case of vibration during machine operation or when directly subjected to external force.

The switching means 7 is provided in the drive transmission path of the drive transmission means 6 and facilitates the providing and stopping of drive transmission to the folding cylinder rotating cam means 4 and the jaw cylinder rotating cam means 5. When drive is not transmitted to the folding cylinder rotating cam means 4 and the jaw cylinder rotating cam means 5, a straight run is carried out, and when drive is transmitted to the folding cylinder rotating cam means 4 and jaw cylinder rotating cam means 5 for activation, a collect run is carried out.

(1) The clutch 74 is provided so as to be moveable in the axial direction via a sliding key (not shown) at the shaft 61 of the drive transmission means 6 shown in FIG. 2 and FIG. 3. The clutch 74 has a recessing and projecting section meshing and engaging with a gear 61*a* supported in a rotating manner at the shaft 61 formed on a side surface facing the gear 61*a*. Further, a recessing and projecting section meshing and engaging with the stopper 66 of the bracket 61*c* is formed on the side surface facing the stopper 66 and a groove 74*a* is provided in a circumferential direction of the central section of the peripheral surface of the clutch 74.

A fluid pressure cylinder 71 is provided at a support side surface at the bracket 61*c* supporting the shaft 61 of the drive transmission means 6 and a support shaft 72 capable of angular displacement of 90 degrees with respect to the axis of the shaft 61 at a central position between the fluid pressure cylinder 71 and the clutch 74.

Arms 73*a* and 73*b* are provided respectively at the ends of the support shaft 72, and a shaft end of one of the arms 73*a* and 73*b* is fitted so as to be integral with the support shaft 72 and is capable of being angularly displaced. A pin is also provided parallel with the support shaft 72 at the shaft end of the other arms 73*a* and 73*b*. A rotating member capable of rotating about the axis of the pins is provided at the pins and this rotating member enters into the groove 74*a* of the clutch 74.

A shaft of the support shaft 72 projects from one shaft end of the arm 73*a* and one shaft end of the arm 73 is provided so as to angularly displace integrally with the support shaft 72 at this shaft.

The other shaft end of the arm 73 is coupled to the end of a rod of the fluid pressure cylinder 71. A solenoid valve (not shown) is connected by piping to the fluid pressure cylinder 71. When this solenoid valve is turned on so as to cause the fluid pressure cylinder 71 to activate and cause the rod of the fluid pressure cylinder 71 to extend, the arms 73*a* and 73*b* angularly displace via the arm 73. The clutch 74 meshes and engages with the gear 61*a* due to the angular displacement of the arms 73*a* and 73*b*. As a result of this coupling, it is possible to transmit rotation from the drive gear 60 of the cutting cylinder C to the folding cylinder rotating cam 40 via the gear 61*a*, shaft 61, gear 61*b*, gear 62*a*, shaft 62, gear 62*b* and gear 41 of the folding cylinder rotating cam means 4.

Further, rotation of the gear 62*a* is transmitted to the gear 64*b* via the gear 63*a*.

When the solenoid valve is turned off and the rod of the fluid pressure cylinder 71 is retracted, the clutch 74 is displaced in a direction away from the gear 61*a*, transmission of rotational drive of the gear 61*a* is stopped, and the clutch 74 meshes with the stopper 66 so as to be stopped.

(2) The clutch 78 is provided so as to be moveable in the axial direction via a slide key (not shown) at the shaft 64 of the drive transmission means 6 shown in FIG. 2 and FIG. 3. The clutch 78 has a recessing and projecting section meshing and engaging with a gear 64*a* supported in a rotating manner at the shaft 64 formed on a side surface facing the gear 64*a*. Further, a recessing and projecting section meshing and engaging with the stopper 67 of the bracket 64*c* is formed on the side surface facing the stopper 67 and a groove 78*a* is provided in a circumferential direction of the central section of the peripheral surface of the clutch 78.

A fluid pressure cylinder 75 is provided at a support side surface at the bracket 64*c* supporting the shaft 64 of the drive transmission means 6 and a support shaft 76 capable of angular displacement of 90 degrees with respect to the axis of the shaft 64 at a central position between the fluid pressure cylinder 75 and the clutch 78.

Arms 77*a* and 77*b* are provided respectively at the ends of the support shaft 76, and a shaft end of one of the arms 77*a* and 77*b* is fitted so as to be integral with the support shaft 76 and is capable of being angularly displaced. A pin is also provided parallel with the support shaft 76 at the other shaft end of the arms 77*a* and 77*b*. A rotating member capable of rotating about the axis of the pins is provided at the pins and this rotating member enters into the groove 78*a* of the clutch 78.

A shaft of the support shaft 76 projects from one shaft end of the arm 77*a* and one shaft end of the arm 77 is provided so as to angularly displace integrally with the support shaft 76 at this shaft.

The other shaft end of the arm 77 is coupled to the end of a rod of the fluid pressure cylinder 75. A solenoid valve (not shown) is connected by piping to the fluid pressure cylinder 75. When this solenoid valve is turned on so as to cause the fluid pressure cylinder 75 to activate and cause the rod of the fluid pressure cylinder 75 to extend, the arms 77*a* and 77*b* angularly displace via the arm 77. The clutch 78 meshes and engages with the gear 64*b* due to the angular displacement of the arms 77*a* and 77*b*.

As a result of this coupling, it is possible for rotation transmitted from the drive gear 60 of the cutting cylinder C transmitted to the gear 64*b* by the coupling of the clutch 74 and gear 61*a* to be transmitted to the jaw cylinder rotating cam 50 via the shaft 64, gear 64*b*, gear 65*a*, shaft 65, gear 65*b* and gear 51 of the jaw cylinder rotating cam means 5.

When the solenoid valve is turned off and the rod of the fluid pressure cylinder 75 is retracted, the clutch 78 is displaced in a direction away from the gear 64*a*, transmission of rotational drive of the gear 64*a* is stopped, and the clutch 78 meshes with the stopper 67 so as to be stopped.

In the above, in the case where the fluid pressure cylinders 71 and 75 of the switching means 7 are put "ON" and the clutches 74 and 78 couple with the gears 61*a* and 64*a* respectively, when the drive gear 60 of the cutting cylinder C rotates, this rotation causes the folding cylinder rotating cam 40 of the folding cylinder rotating cam means 4 and the jaw cylinder rotating cam 50 of the jaw cylinder rotating cam means 5 to be connected via each of the gears of the drive transmission means 6 meshing with the drive gear 60.

The rotational speed ratio of the cutting cylinder C, the folding cylinder rotating cam 40 of the folding cylinder rotating cam means 4, and the jaw cylinder rotating cam 50 of the jaw cylinder rotating cam means 5 is 1:⅓:½, and the angular displacement ratio is 360:120:180. The rotational speed ratio and angular displacement ratio are set for the gear number of each gear of the drive transmission means 6.

Further, the circumferential speed of the folding cylinder D and the jaw cylinder E accompanying the rotation of the cutting cylinder C is the same as the circumferential speed of the cutting cylinder C. The cylinder circumferential length ratio of the cutting cylinder C, folding cylinder D and jaw cylinder E is 2:5:5. Because of this, the rotational speed ratio of the cutting cylinder C, the folding cylinder D and the jaw cylinder E is 1:⅖:⅖ and the angular displacement ratio is 360:144:144.

The switching positions of the clutches 74 and 78 of the switching means 7 are shown in FIG. 5 and FIG. 6. Clutch switching alignment marks C4 and C5 are provided at the side surface of the cutting cylinder C. An indicator C3 is fitted to the frame I and switching over of the clutches 74 and 78 is carried out at positions aligned with alignment marks C4 and C5 at this indicator C3.

The number of teeth for each gear is set in such a manner that the ratio of the rotational speed N4 of the gear 41 of the folding cylinder rotating cam 40 of the folding cylinder rotating cam means 4 and the rotational speed ND of the gear (not shown) provided at the shaft Da of the folding cylinder D, i.e. the ratio of the rotational speed N4 of the folding cylinder rotating cam 40 and the rotational speed ND of the folding cylinder D (the ratio of rotation of the folding cylinder rotating cam with respect to the folding cylinder D) becomes rotational speed N4: rotational speed ND=5:6.

Further, the number of teeth for each gear is set in such a manner that the ratio of the rotational speed N5 of the gear 51 of the jaw cylinder rotating cam 50 of the jaw cylinder rotating cam means 5 and the rotational speed NE of the gear (not shown) provided at the shaft Ea of the jaw cylinder E, i.e. the ratio of the rotational speed N5 of the jaw cylinder rotating cam 50 and the rotational speed NE of the jaw cylinder E (the ratio of rotation of the rotation cam 50 with respect to the jaw cylinder E) becomes rotational speed N5: rotational speed NE=5:4.

Therefore, when the folding cylinder D rotates by 72 (a distance the size of the gap with the pins D1), the folding drum rotation cam 40 is set to rotate by sixty degrees.

Further, when the jaw cylinder E rotates by 72 (a distance the size of the gap with the jaw mechanism E1), the jaw drum rotation cam 50 is set to rotate by ninety degrees.

A description is now given of a folding machine with a collect run mode 1 of the embodiment of this invention. In the straight run situation shown in FIG. 5, the folding machine with a collect run mode 1 is stopped at the wait position 43 where the covering sections 42*a*, 42*b*, and 42*c* provided at the folding cylinder cam 40 of the folding cylinder rotating cam means 4 do not block the pin retraction region X of the folding cylinder fixed cam 20 of the folding cylinder fixed cam means 2. The covering sections 52*a* and 52*b* provided at the jaw cylinder rotating cam 50 of the jaw cylinder rotating cam means 5 is halted at a standby position 53 where the jaw closed range Y of the jaw cylinder fixed cam 50 of the jaw cylinder rotating cam means 5 is not covered.

At this time, each of the rods of the fluid pressure cylinders 71 and 75 of the switching means 7 are retracted, the clutches 74 and 78 come away from the gears 61*a* and 64*a* via the arms 73, 73*a*, 77 and 77*a* and mesh so at so couple with the stoppers 66 and 67, and rotation of the shafts 61 and 64 is stopped. Rotation of the folding cylinder rotating cam 40 coupled with the shaft 61 via the gear 61*b*, gear 62*a*, shaft 62, gear 62*b* and gear 41 is therefore halted and rotation of the jaw cylinder rotating cam 50 coupled to the shaft 64 via the gear 64*a*, gear 65*a*, shaft 65, gear 65*b* and gear 51 is also halted.

As a result, in the case of straight run operation also, there is no angular displacement of each of the gears of the drive transmission means 6, or the folding cylinder rotating cam 40 at the standby position 43, or of the jaw cylinder rotating cam 50 at the standby position 53.

(A) A description is now given of switching over from a straight run mode to a collect run mode.

(1) In order to switch the folding machine with a collect run mode 1 operating in straight run mode over to a collect run mode, first, the folding machine with a collect run mode 1 in a halted state is operated by an operator. The cutting cylinder C rotates at low speed in the direction of the arrow shown in FIG. 5 and rotation of the cutting cylinder C is halted at the position where the alignment mark C4 provided on the cutting cylinder C lines up with the indicator C3 provided on the frame I. The solenoid valve of the fluid pressure cylinder 71 of the switching means 7 is put on, the rod of the fluid pressure cylinder 71 is extended, the clutch 74 is drawn away from the stopper 66 so as to release the state where rotation is stopped, the clutch 74 meshes so as to couple with the gear 61*a*, and the gear 62*b* is made to rotate via the shaft 61*b*, gear 62*b* and shaft 62. As a result, rotational drive is transmitted from the drive gear 60 of the cylinder C to the gear 41 of the folding cylinder rotating cam 40. The folding cylinder rotating cam 40 provided at the gear 41 is capable of rotating due to the rotation of the folding cylinder D and the prescribed rotational speed ratio.

(2) Next, cutting cylinder C rotates at low speed in the direction of the arrow shown in FIG. 6 and rotation is halted at the position where the alignment mark C5 provided on the cutting cylinder C lines up with the indicator C3. The solenoid valve of the fluid pressure cylinder 75 of the switching means 7 is put on, the rod of the fluid pressure cylinder 75 is extended, the clutch 78 is drawn away from the stopper 67 so as to release the state where rotation is stopped, the clutch 78 meshes so as to couple with the gear 64*b*, and the gear 65*b* is made to rotate via the gear 64*a*, gear 65*a*, and shaft 65. As a result, rotational drive is transmitted from the drive gear 60 of the cutting cylinder C to the gear 51 of the jaw cylinder rotating cam 50. The jaw cylinder rotating cam 50 provided at the gear 51 is capable of rotating due to the rotation of the folding cylinder D and the prescribed rotational speed ratio.

Figure 7:
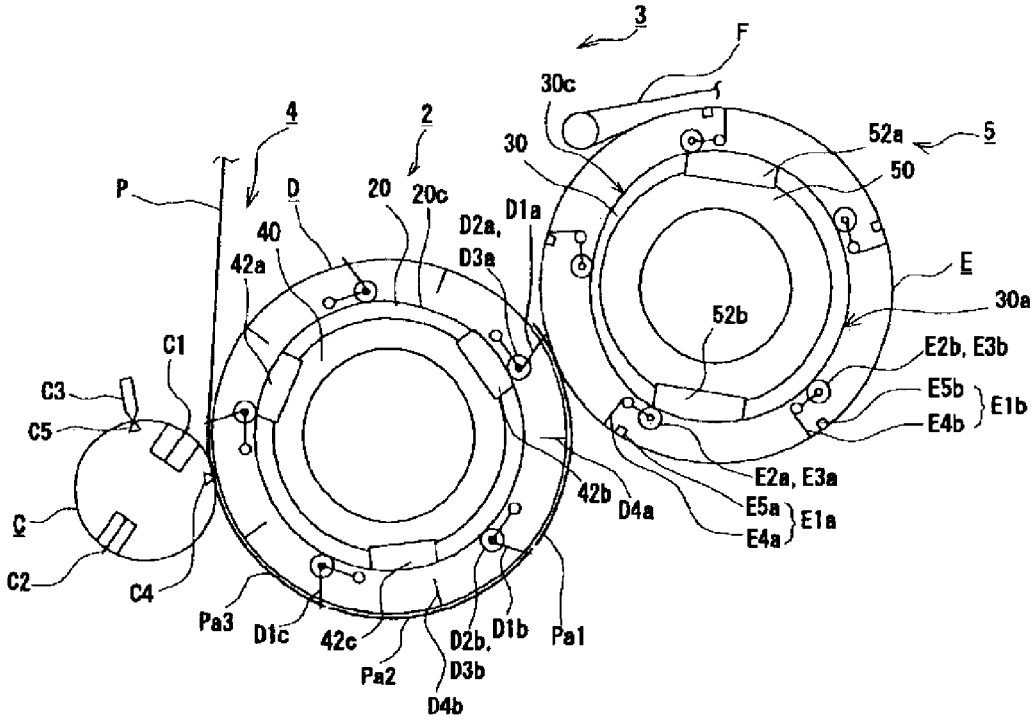
FIG. 7 is a view illustrating folding cylinder rotating cam means and jaw cylinder rotating cam means for a collect run of the folding machine with a collect run mode of the embodiment of the invention.

(3) FIG. 7 to FIG. 15 are sequential views showing situations as the cutting cylinder C is sequentially angularly displaced by 45 degrees. The situation shown in FIG. 7 shows the situation when changing over from a straight run to a collect run. The pins D1*a* and D1*b* of the folding cylinder D support the leading ends of the cut paper Pa1 and Pa2 cut by the blades C1 and C2 of the cutting cylinder C.

At the rotation phase shown in FIG. 7, the upstream portion in the rotational direction of the covering section 42*b* of the folding cylinder rotating cam 40 overlaps with the pin retraction region X of the folding cylinder fixed cam 20 so that the pin retraction region X is blocked.

The follower D2*a* coupling with the pins D1*a* is in front of the pin retraction region X of the folding cylinder fixed cam 20 and makes contact with the round guide surface 20*a* of the folding cylinder fixed cam 20. Similarly, the follower D3*a* coupling with the pins D1*a* is in front of the pin retraction region X of the folding cylinder fixed cam 20 and makes contact with the guide surface of the downstream-side section in the direction of rotation of the covering section 42*b* of the folding cylinder rotating cam 40.

The cam follower E2*a* coupling with the jaw anvil E4*a* of the jaw mechanism E1*a* of the jaw cylinder E facing the folding blade D4*a* is in front of the jaw closed range Y of the jaw cylinder fixed cam 30 and makes contact with the round guide surface 30*a* of the jaw cylinder fixed cam 30. The cam follower E3*a* coupling with the same jaw anvil E4*a* makes contact with the guide surface of the downstream portion in the direction of rotation of the covering section 52*b* of the jaw cylinder rotating cam 50.

Figure 8:
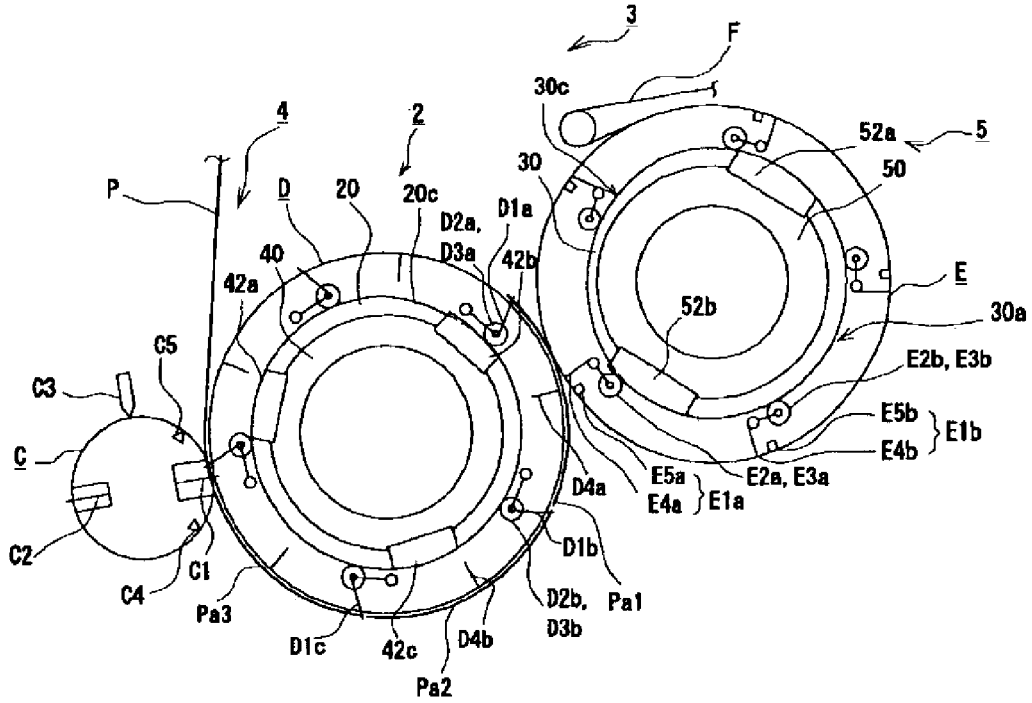
FIG. 8 is another view illustrating folding cylinder rotating cam means and jaw cylinder rotating cam means for a collect run of the folding machine with a collect run mode of the embodiment of the invention.
Figure 9:
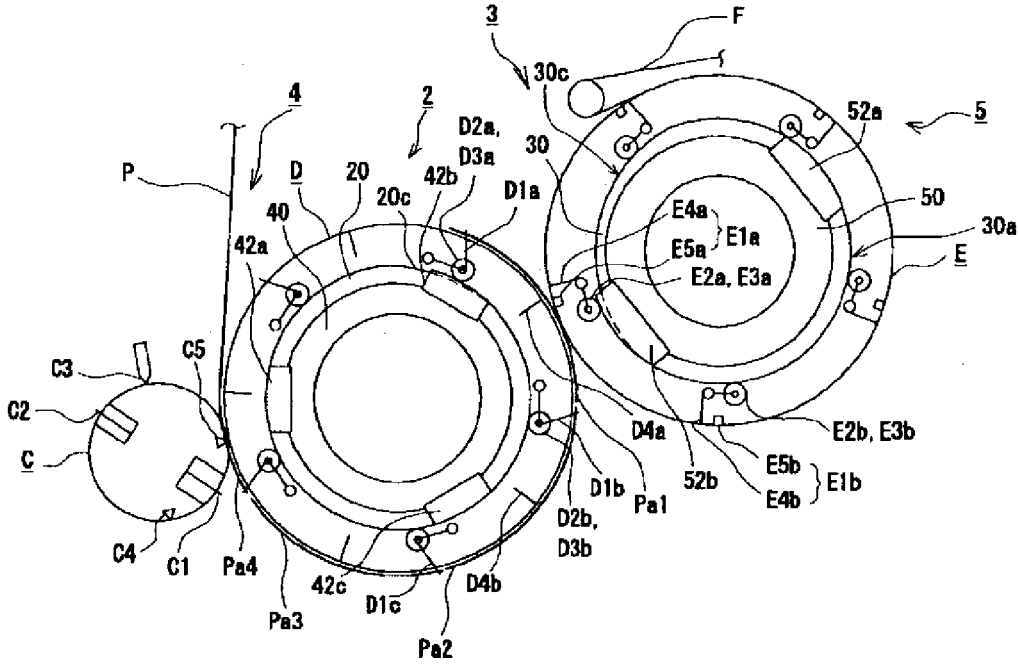
FIG. 9 is a further view illustrating folding cylinder rotating cam means and jaw cylinder rotating cam means for a collect run of the folding machine with a collect run mode of the embodiment of the invention.
Figure 10:
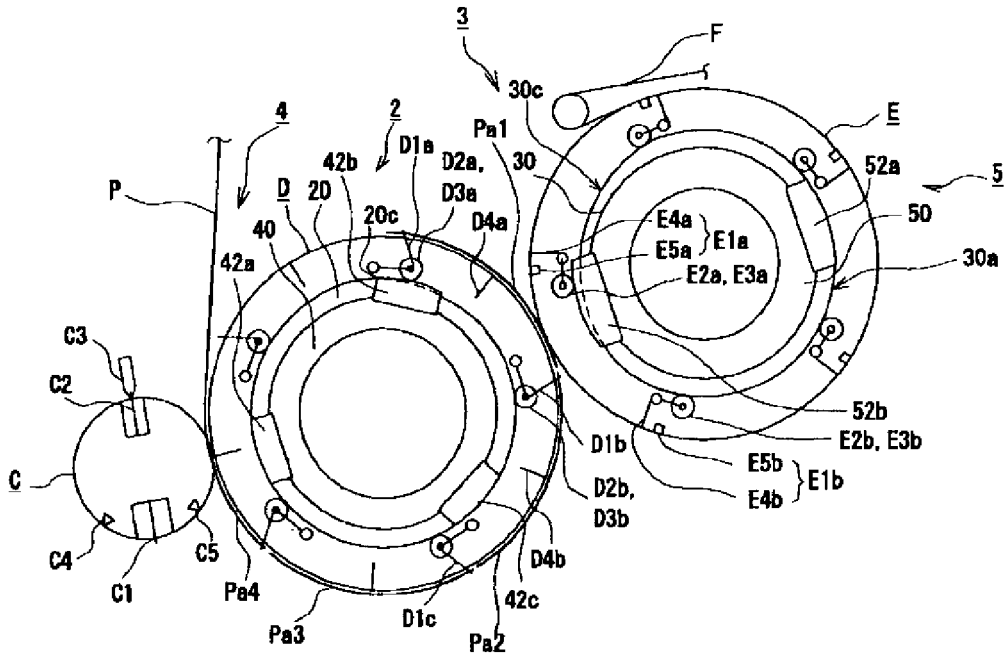
FIG. 10 is a still further view illustrating folding cylinder rotating cam means and jaw cylinder rotating cam means for a collect run of the folding machine with a collect run mode of the embodiment of the invention.

(4) From the situation for the rotation phase shown in FIG. 7 to the rotation phases shown for sequential rotation through 45 degrees in FIG. 8, FIG. 9 and FIG. 10, the cam follower D3*a* of the folding cylinder D is in a state of making contact with the guide surface of the covering section 42*b*. The cam follower D2*a* moves without making contact with the retraction range guide surface 20*c* of the pin retraction region X of the folding cylinder fixed cam 20. The pins D1*a* therefore do not retract from the surface of the folding cylinder D and the leading part of the cut paper Pa1 continues to be held.

The covering section 52*b* of the jaw cylinder rotating cam 50 of the jaw cylinder E moves to the jaw closed range Y of the jaw cylinder fixed cam 30 and the cam follower E3*a* coupling with the jaw blade E4*a* comes into contact with the guide surface of the covering section 52*b*. Therefore, at the position where the gap between the folding cylinder D and the jaw cylinder E is minimum, even if the jaw blade E4*a* faces the folding blade D4*a*, the covering section 52*b* moves without the jaw blade E4*a* closing and with the gap with the jaw anvil E5*a* maintained, and the cut paper Pa1 is not held.

Figure 11:
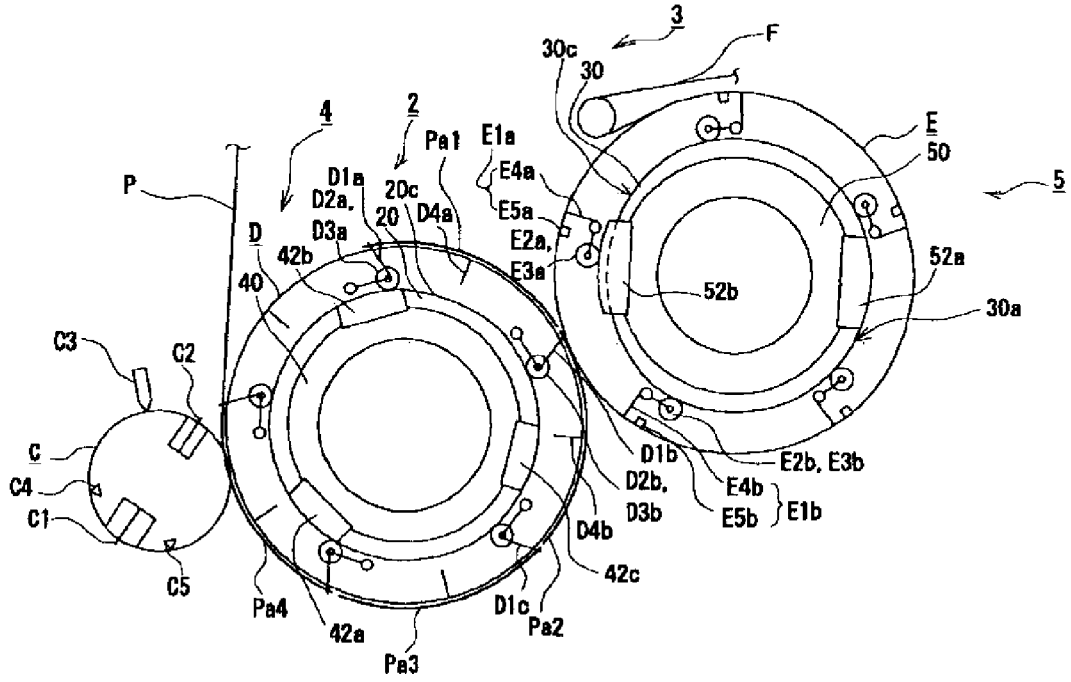
FIG. 11 is another view illustrating folding cylinder rotating cam means and jaw cylinder rotating cam means for a collect run of the folding machine with a collect run mode of the embodiment of the invention.

In the rotation phase of FIG. 11 showing the situation where there is rotation about 45 degrees from the situation in FIG. 10, the cam follower D2*b* coupling with the pins D1*b* of the folding cylinder D comes into contact with the round guide surface 20*a* in front of the pin retraction region X of the folding cylinder fixed cam 20 and is positioned at a substantially central region between the covering sections 42*b* and 42*c* of the folding cylinder rotating cam 40. At this time, the pins D1*b* hold the leading part of the cut paper Pa2.

The cam follower E2*b* coupling with the jaw blade E4*b* of the jaw cylinder E is in contact with the round guide surface 30*a* in front of the jaw closed range Y of the jaw cylinder fixed cam 30 and the cam follower E3*b* coupling with the jaw blade E4*b* is positioned at a substantially central region between the covering sections 42*b* and 42*c* of the jaw cylinder rotating cam 50. At this time, the jaw blade E4*b* is open so as to open up a gap with the jaw anvil E5*b*.

Figure 12:
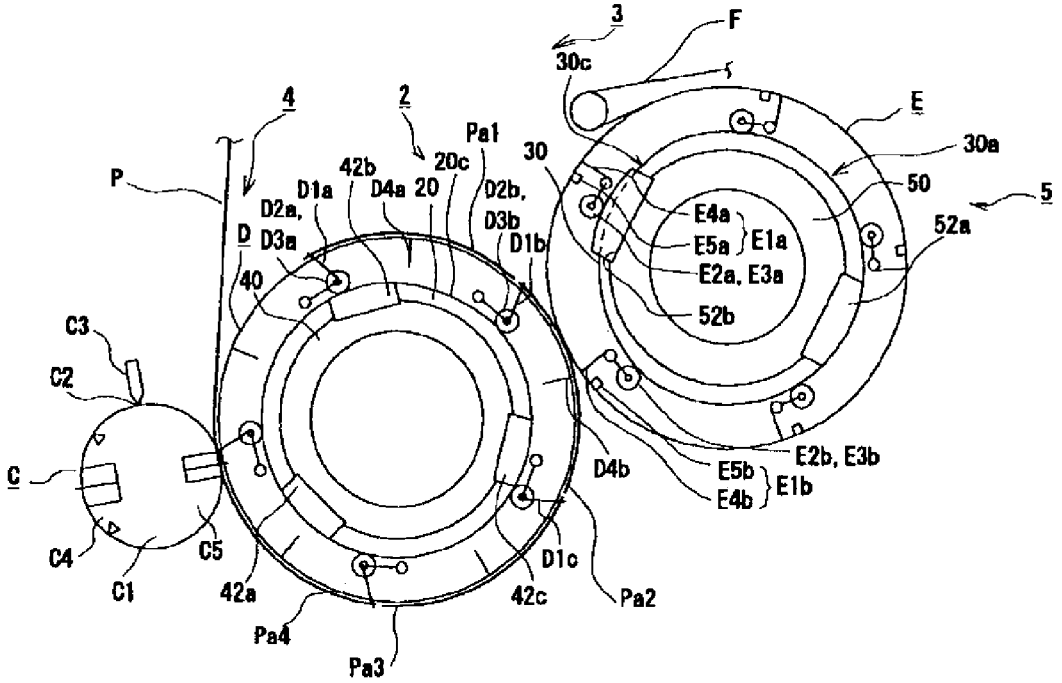
FIG. 12 is a further view illustrating folding cylinder rotating cam means and jaw cylinder rotating cam means for a collect run of the folding machine with a collect run mode of the embodiment of the invention.
Figure 13:
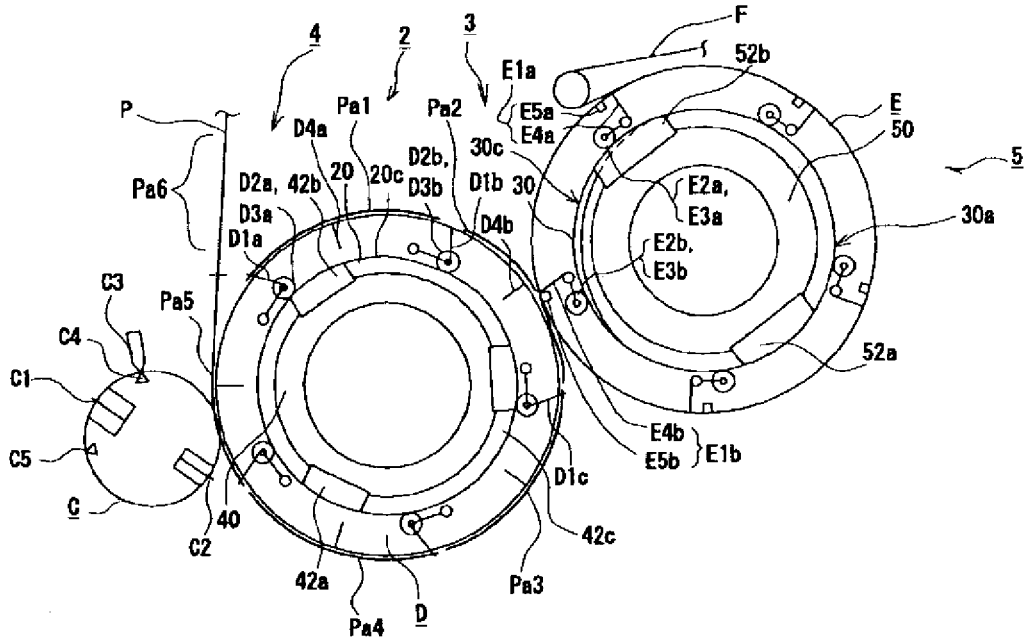
FIG. 13 is a still further view illustrating folding cylinder rotating cam means and jaw cylinder rotating cam means for a collect run of the folding machine with a collect run mode of the, embodiment of the invention.

In the rotation phases of FIG. 12 and FIG. 13 showing situations where there is sequential rotation through 45 degrees each time from the situation in FIG. 11, the rotation of the folding cylinder D and the jaw cylinder E progresses, and the cam follower D2*b* of the folding cylinder D is positioned above the retraction range guide surface 20*c* of the pin retraction region X of the folding cylinder fixed cam 20, and in accompaniment with this, the pins D1*b* retract from the cylinder surface and the held cut paper Pa2 is released.

On the other hand, the cam follower E2*b* of the jaw cylinder E is positioned above the closed range guide surface 30*c* of the jaw closed range Y of the jaw cylinder fixed cam 30. In accompaniment with this, the jaw blade E4*b* is displaced towards the side of the jaw anvil E5*b*, and at a position where the gap between the folding cylinder D and the jaw cylinder E is a minimum, facing the folding blade D4*b*, together with the folding blade D4*b* acts so as to hold the center of the cut paper Pa2 where the folding blade D4*b* projects, so that the central part of the cut paper Pa2 is held and supported at the cylinder surface. The pins D1*b* are then retracted from the cylinder surface at the correct timing and the leading part of the cut paper Pa2 is released.

Figure 14:
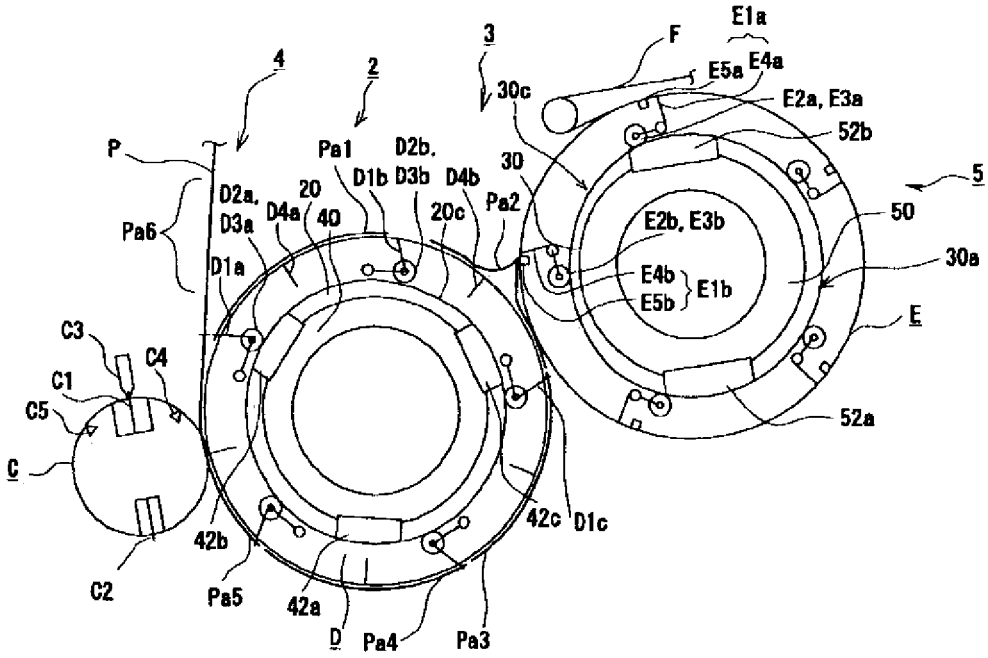
FIG. 14 is another view illustrating folding cylinder rotating cam means and jaw cylinder rotating cam means for a collect run of the folding machine with a collect run mode of the embodiment of the invention.
Figure 15:
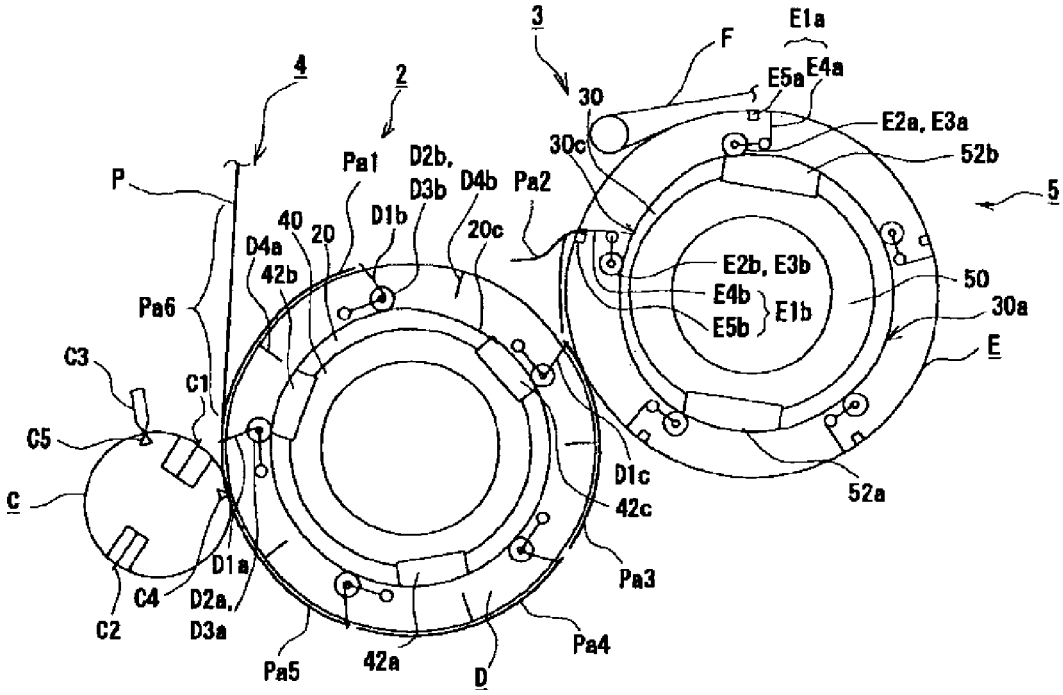
FIG. 15 is a further view illustrating folding cylinder rotating cam means and jaw cylinder rotating cam means for a collect run of the folding machine with a collect run mode of the embodiment of the invention.

At the rotation phases in FIG. 14 and FIG. 15 showing the situations after rotating 45 degrees at a time from the situation shown in FIG. 13, the pins D1*a* of the folding cylinder D hold the leading part of the cut paper Pa1 as is and penetrate the paper web P. FIG. 15 is a view showing the situation at the same rotation phase as in FIG. 7. Therefore, when rotation proceeds from FIG. 15 sequentially 45 degrees at a time so as to reach the same state of rotation phase as in FIG. 12, the cut paper Pa4 newly shown in FIG. 15 is cut sequentially from the paper web P, and is overlaid on the cut paper Pa1 of the cylinder surface.

The cut paper Pa2 supported by the jaw blade E4*a* and the jaw anvil E5*b* of the jaw cylinder E is moved from the folding cylinder D to the jaw cylinder E in accompaniment with rotation of the jaw cylinder E, and is folded at the central part to give the signature Pb. When rotation advances from FIG. 15 sequentially 45 degrees at a time to give the same situation as the rotation phase in FIG. 10, the cam follower E2*b* supporting the signature Pb moves from the closed range guide surface 30*c* of the jaw closed range Y of the jaw cylinder fixed cam 30 onto the round guide surface 30*a*. The jaw blade E4*b* then comes away from the jaw anvil E5*b* so as to release the held signature Pb. The released signature Pb is pushed onto the cylinder surface by the conveyor belt F so as to be conveyed.

A description is given of the operation of the folding machine with a collect run mode 1 of an embodiment of this invention where an odd number of rows of pins (in this case five rows) D1 provided at the folding cylinder D release the cut paper Pa supported every other row in accompaniment with rotation of the folding cylinder D and an odd number (five) of jaw mechanisms provided at the jaw cylinder E so as to correspond to this cut paper Pa also carry out jaw operations every other row.

With the cut paper Pa2 and cut paper Pa4 supported at the surface of the folding cylinder D shown in FIG. 15, at the start of operation, the cut paper that is not overlaid as two on the surface of the folding cylinder D is removed as waste after reaching the conveyor H.

Further, as with the cut paper Pa1 and the cut paper Pa6, the cut paper Pa overlaid at two parts on the surface of the folding cylinder D held by the jaw mechanism E1 is transported using the conveyor H as the signature Pb for the collect folding.

The cut paper Pa3 held by the pins D1*c* is also overlaid with the newly cut cut paper Pa, folded as a collect run signature and transported using the conveyor H using the same process as for the cut paper Pa1.

(B) A description is now given of switching over from a collect run to a straight run.

(1) The operation of switching over from a collect run to a straight run is the opposite of the operation for switching over from a straight run to a collect run described in (1) of (A).

Namely, the folding machine with a collect run mode 1 operating in the collect run mode is halted. An operator makes the folding machine with a collect run mode 1 go from a stationary state to a state of rotating at a low rotational speed, and as shown in FIG. 6, rotation of the cutting cylinder C stops at the position where the alignment mark C5 provided on the cutting cylinder C lines up with the indicator C3 provided on the frame I. The solenoid valve of the fluid pressure cylinder 75 of the switching means 7 shown in FIG. 2 is then turned off, the rod of the fluid pressure cylinder 75 is retracted, and meshing and engaging of the clutch 78 with the gear 64*b* is released to give a distance between the clutch 78 and the gear 64*b*. Rotational drive from the drive gear 60 of the cutting cylinder C to the jaw cylinder rotating cam 50 of the jaw cylinder rotating cam means 5 is not transmitted and the jaw cylinder rotating cam 50 no longer revolves and is halted at the position of the standby position 53. The clutch 78 meshes with the stopper 67 and the jaw cylinder rotating cam 50 is constrained.

(2) The cutting cylinder C rotates at low speed in the direction of the arrow shown in FIG. 5 and rotation is halted at the position where the alignment mark C4 provided on the cutting cylinder C lines up with the indicator C3 provided on the frame I. The solenoid valve of the fluid pressure cylinder 71 of the switching means 7 is then turned off, the rod of the fluid pressure cylinder 71 is retracted, and meshing and engaging of the clutch 74 with the gear 61*a* is released to give a distance between the clutch 74 and the gear 61*a*.

Rotational drive from the drive gear 60 of the cutting cylinder C to the gear 41 of the folding cylinder rotating cam 40 is not transmitted and the folding cylinder rotating cam 40 provided at the gear 41 no longer revolves and is halted at the position of the standby position 43. The clutch 74 meshes with the stopper 66 and the folding cylinder rotating cam 40 is constrained.

Switching over from a collect run to a straight run is then finished as a result of this operation.

According to this invention, sequential operation of each of the jaw mechanisms of the jaw cylinder is halted during a collect run. There is therefore no bias in the frequency of operation of the jaw mechanisms, which means that a situation where part of the jaw mechanisms is worn and lifespan is shortened is prevented. Further, rapid wear of the jaw mechanism due to paperless strikes is prevented.

This means that the amount of maintenance that the folding machine with a collect run mode requires is reduced and a longer time of use is possible.

What is claimed is:

1. A folding machine with a collect run mode, having a cutting cylinder equipped with cutting blades for cutting a paper web to give cut paper, a folding cylinder provided next to the cutting cylinder and provided with an odd number of pins for holding the cut paper positioned at equal distances along the direction of the peripheral surface of the folding cylinder surface and an odd number of folding blades are provided with ends projecting slightly from a surface of the folding cylinder surface positioned at a central part of the held cutting paper, and positioned at equal distances along the direction of the peripheral surface of the folding cylinder surface, a jaw cylinder next to the folding cylinder provided with a jaw mechanism for holding and supporting a central part of the cut paper made to project by a folding blade, and being capable of switching between a straight run where the jaw cylinder sequentially supports the cut paper and the cut paper is folded and a collect run where two pieces of the cut paper are sequentially overlaid by the folding cylinder and the jaw cylinder sequentially supports and then folds the two overlaid pieces of cut paper, said folding machine with collect run mode comprising:

folding cylinder fixed cam means having a folding cylinder fixed cam of a cam shape for making the pins of the folding cylinder perform a straight run delivery operation;

folding cylinder rotating cam means having a folding cylinder rotating cam that rotates separately from the rotation of the folding cylinder, and is provided with covering sections capable of covering a cam shape capable of carrying out a straight run delivery operation of the folding cylinder cam by rotational displacement;

jaw cylinder fixed cam means having ajar cylinder fixed cam of a cam shape for making the jaw mechanism of the jaw cylinder perform a straight run delivery operation;

jaw cylinder rotating cam means having a jaw cylinder rotating cam that rotates separately from the rotation of the jaw cylinder, and is provided with covering sections capable of covering a cam shape capable of carrying out a straight run delivery operation of the jaw cylinder cam by rotational displacement;

drive transmission means capable of providing rotational drive simultaneously to the folding cylinder rotating cain means and the jaw cylinder rotating cam means in order to cause the covering sections of the folding cylinder rotating cam means to rotate at a predetermined rotational speed ratio with respect to rotation of the folding cylinder, and cause the covering sections of the jaw cylinder rotating cam means to rotate at a predetermined rotational speed ratio with respect to rotation of the jaw cylinder; and switching means for switching drive transmission over between the folding cylinder rotating cam means and the jaw cylinder rotating cam means, wherein an all of the jaw mechanisms operate at the same frequency without exception during collect run mode.

2. The folding machine with a collect run mode as disclosed in claim 1, wherein the folding cylinder fixed cam is provided fixed between a folding cylinder side surface and a frame, and the covering section of the folding cylinder rotating cam are provided between the folding cylinder side surface and the folding cylinder fixed cam so as too be rotatable about a central axis of the folding cylinder, the jaw cylinder fixed cam is provided fixed between the jaw cylinder side surface and the frame, and the covering sections of the jaw cylinder fixed cam are provided between the jaw cylinder side surface and the jaw cylinder fixed cam so as to be rotatable about the central axis of the jaw cylinder.

3. The folding machine with a collect run mode as disclosed in claim 1, wherein sequential operation of each jaw mechanism is halted during a collect run mode.

4. The folding machine with a collect run mode as disclosed in claim 1, wherein when the folding machine switches from a collect run mode to a straight run mode, the drive transmission means stops transmitting rotational drive to the jaw cylinder rotating cam, stopping the jaw cylinder rotating cam from revolving.

5. The folding machine with a collect run mode as disclosed in claim 4, wherein the jaw cylinder rotating cam halts at a standby position.

6. A folding machine with a collect run mode, comprising:

a cutting cylinder equipped with cutting blades for cutting a paper web to give cut paper;

a folding cylinder provided next to the cutting cylinder and provided with an odd number of pins for holding the cut paper and positioned at equal distances along the direction of the peripheral surface of the folding cylinder surface, and an odd number of folding blades are provided with ends projecting slightly from a surface of the folding cylinder surface positioned at a central part of the held cutting paper and positioned at equal distances along the peripheral surface of the folding cylinder surface;

a jaw cylinder next to the folding cylinder provided with jaw mechanisms for holding and supporting a central part of the cut paper made to project by a folding blade, and being capable of switching between a straight run where the jaw cylinder sequentially supports the cut paper and the cut paper is folded and a collect run where two pieces of the cut paper are sequentially overlaid by the folding cylinder and the jaw cylinder sequentially supports and then folds the two overlaid pieces of cut paper;

a folding cylinder fixed cam for making the pins of the folding cylinder perform a straight run mode operation;

a folding cylinder rotating cam that rotates separately from the rotation of the folding cylinder, and provided with covering sections capable of covering a cam shape capable of carrying out a straight run delivery operation of the folding cylinder cam by rotational displacement;

a jaw cylinder fixed cam of a cam shape for making the jaw mechanism of the jaw cylinder perform a straight run delivery operation;

a jaw cylinder rotating cam that rotates separately from the rotation of the jaw cylinder, and provided with covering sections capable of covering a cam shape capable of carrying out a straight run delivery operation of the jaw cylinder cam by rotational displacement;

a drive transmission capable of providing rotational drive simultaneously to the folding cylinder rotating cam and the jaw cylinder rotating cam in order to cause the covering sections of the folding cylinder rotating cam to rotate at a predetermined rotational speed ratio with respect to rotation of the folding cylinder, and cause the covering sections of the jaw cylinder rotating cam to rotate at a predetermined rotational speed ratio with respect to rotation of the jaw cylinder; and a switching mechanism for switching drive transmission over between the folding cylinder rotating cam and the jaw cylinder rotating cam, wherein the folding machine is configured to prevent a paperless strike of a jaw mechanism of a jaw cylinder during a collect run mode.

7. The folding machine with a collect run mode of claim 6, wherein the jaw mechanisms of the jaw cylinder operate at an equal frequency.

8. The folding machine with a collect run mode as disclosed in claim 6, wherein when the folding machine switches from a collect run mode to a straight run mode, the drive transmission means stops transmitting rotational drive to the jaw cylinder rotating cam, stopping the jaw cylinder rotating cam from revolving.

* * * * *